US005727497A

United States Patent [19]

Nichols, Jr.

[11] Patent Number: 5,727,497

[45] Date of Patent: Mar. 17, 1998

[54] FLAG SYSTEM FOR DISPLAYING A FLAG FROM A HOOD OF AN AUTOMOBILE

[76] Inventor: John A. Nichols, Jr., 10556 Emerald Ridge, #8, St. Louis, Mo. 63114

[21] Appl. No.: 661,902

[22] Filed: Jun. 12, 1996

[51] Int. Cl.[6] ..... G09F 17/00

[52] U.S. Cl. ..... 116/173; 116/28 R

[58] Field of Search ..... 116/28 R, 173, 116/174, 175, 209; 248/534, 535, 536, 537, 538, 539, 540, 541; 40/591, 592

[56] References Cited

U.S. PATENT DOCUMENTS

| | | | |
|---|---|---|---|
| 1,025,904 | 5/1912 | Earhart | 116/173 |
| 1,228,092 | 5/1917 | Brewer | 116/173 |
| 1,266,770 | 5/1918 | Burton | 248/540 |
| 1,317,445 | 9/1919 | Hoffman | 116/173 |
| 2,680,588 | 6/1954 | Wright | 116/173 X |
| 3,242,901 | 3/1966 | Olson | 116/173 |
| 3,563,200 | 2/1971 | Grossman | 116/28 R |
| 3,946,509 | 3/1976 | McCaffrey | 116/28 R X |
| 4,135,192 | 1/1979 | Purduhn | 248/539 X |
| 5,453,756 | 9/1995 | Lowrey | 248/539 X |

*Primary Examiner*—William A. Cuchlinski, Jr.
*Assistant Examiner*—Willie Morris Worth
*Attorney, Agent, or Firm*—Peoples & Hale; Veo Peoples, Jr.; J. William Stader

[57] ABSTRACT

The invention is a flag system for displaying a flag from a hood of an automobile. The primary embodiment consists of a mast with a pin which is inserted into the mast. The pin prevents the flag from creeping up the mast. The flag system is held in position between the hood and car by a tongue. A threaded portion and a threaded nut are located on the mast. The threaded nut is tightened, clamping the tongue onto the car hood.

7 Claims, 2 Drawing Sheets

FLAG SYSTEM FOR DISPLAYING A FLAG FROM A HOOD OF AN AUTOMOBILE

BACKGROUND OF INVENTION

1. Field of the Invention

This invention relates to the field of devices for attaching a flag to an automobile's hood region. More specifically, the invention is a system for an easy to place and remove flag mast.

2. Description of Prior Art

Often it is desirable for an individual to display a symbol or flag from an automobile. These displays take many forms. Some individuals place bumper stickers on their car, others place pennants or flags from the car and some individuals prefer to place signs on the sides of the car. Each of these methods have advantages and disadvantages. Bumper stickers and signs can damage the surface of the car, thus reducing its resale value. Most flags are difficult to attach to a car without interfering with the operation of the car. The present art relating to the use of flags on automobiles focuses on three types of attachment means. The first, and most prevalent, is the use of an attachment system which affixes to a window on the car. There are several drawbacks to such an attachment scheme. First, the device prevents the operation of the window. Second, the device is usually wedged either between the window and window frame or in the door jamb. This prevents the door or window from being tightly closed. Because of the close tolerances in modern automobiles, this results in allowing the 'road noise' from being heard inside the car. Finally, the presence of the flag adjacent to the window could create a 'blind' spot resulting in the hazardous operation of the car. Another type of attachment system uses the car's radio antenna as a flag mast. Unfortunately, many cars lack a vertical antenna or the antenna retracts into the car body. Another drawback is that a flag attached to the radio antenna may also damage the antenna during use or installation. A final attachment system typically attaches the flag mast to the bumper or hood. Unfortunately, these attachments are usually permanently fixed onto the vehicle.

It should also be mentioned that all of existing flag systems lack the means to ensure that the flag is kept vertically taut. Frequently, the wind results in the base of the flag 'creeping' up the mast.

The following patents are illustrative of the general state of the existing art.

U.S. Pat. No. 4,650,147 discusses a flagstaff which can be attached onto a bracket. The bracket can be affixed onto a window. The flagstaff and flag can be removed from the bracket. The bracket is inserted onto a vehicle window.

U.S. Pat. No. 3,158,132 discusses a pennant holder. The holder is L-shaped and is permanently affixed to a car window. The system lacks the means to ensure that flag remain vertically taut.

U.S. Pat. No. 3,127,868 discusses a means for attachment of a pennant staff to automobiles. It discloses a secondary embodiment for affixing the flagstaff mounting apparatus onto a surface of the car. A forked attachment is inserted into the mounting apparatus. Again, the attachment means is permanent and the flag cannot remain vertically taut.

A flag system which could overcome the above deficiencies would represent a great advance in this field.

OBJECTS OF THE INVENTION

It is an object of the present invention to provide an flag system for displaying a flag from the hood of an automobile.

It is a further object of the present invention to provide a display device which is easy to install and easy to remove from an automobile's hood.

It is a further object of the present invention to provide a flag system which permits the flag to remain vertically taut and prevents wind 'creep'.

It is a further object of the present invention to provide a flag system which allows the flag system to be removed without damaging the surface of the vehicle.

SUMMARY OF THE INVENTION

The present invention is an apparatus which overcomes the deficiencies in the prior art. The device is an flag system for displaying a flag from the hood of an automobile. The device has a primary and a secondary embodiment for a flag attachment means. The device also has a primary and a secondary embodiment for the hood gripping means. The primary embodiment of the flag attachment means consists of a flag mast with and a pin. The pin is inserted into the mast and holds the flag down. The secondary embodiment consists of two opposing flexible masts with opposing gripping teeth. The masts have conical tips. A flag is inserted between the masts and gripped by the teeth. The mast is held together by a crown which is inserted onto the conical tips. The first embodiment of the hood gripping means consists of a mast with a threaded portion. A clamping nut is tightened onto the car. The secondary embodiment consists of a sliding clamp cap with a plurality of interior teeth. The teeth grip the mast.

At the base of the mast is a tongue which is inserted between the opening between the car hood and side. The tongue may be adjusted for the thickness of the hood by adjusting the male and female mounting threads.

DETAILED DESCRIPTION OF THE INVENTION

Figure 1:
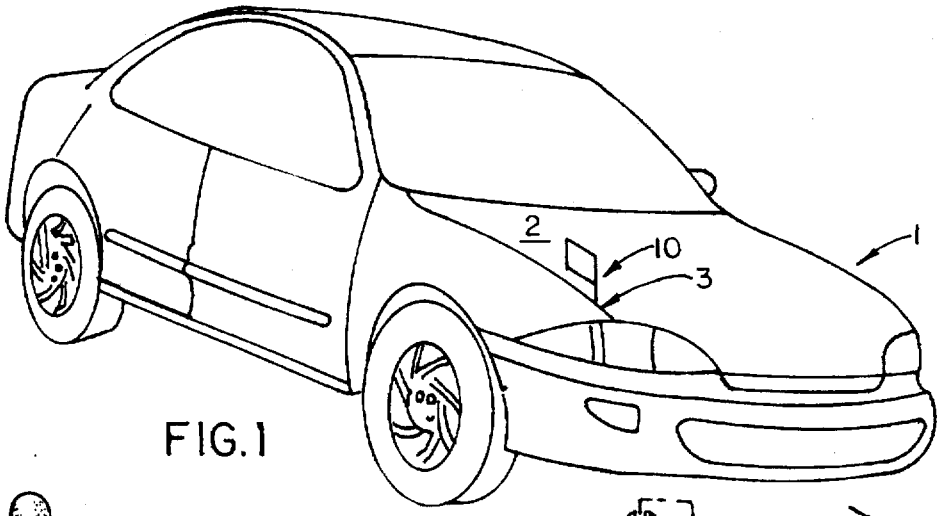
FIG. 1 is a perspective view which illustrates the general location of the present invention.
Figure 2A:
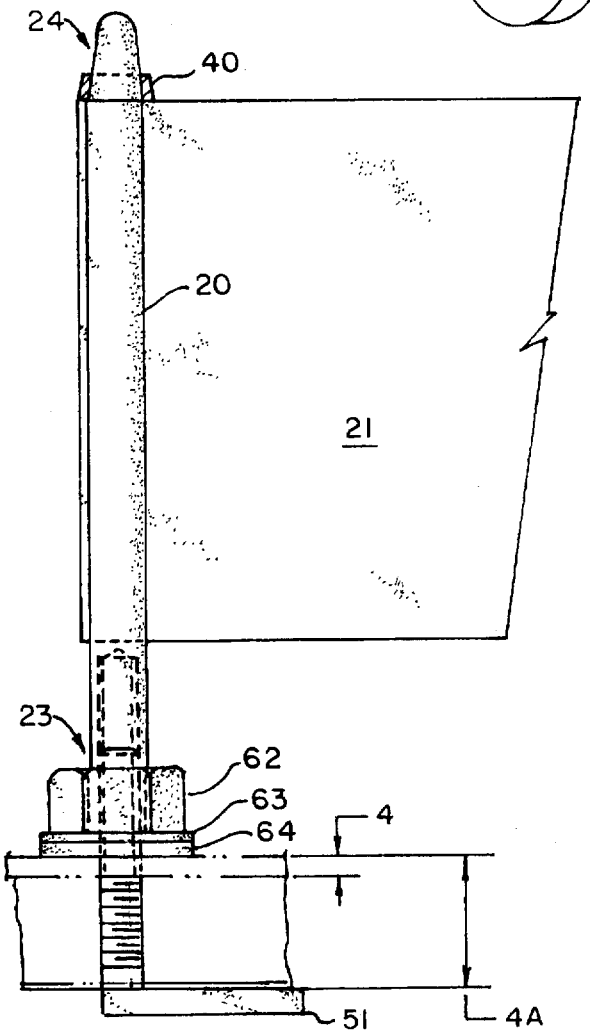
FIG. 2A is a side view which illustrates of the primary embodiment of the flag attachment means of the present invention.
Figure 5:
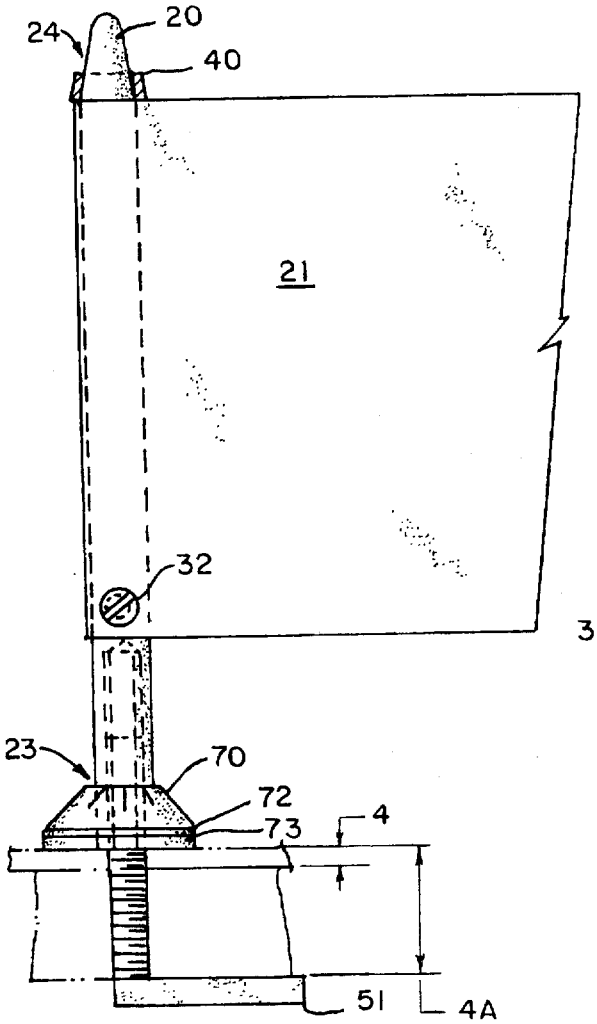
FIG. 5 is a side view which illustrates the secondary embodiment of the flag attachment means of the present invention.

Referring to figures, it is possible to view the various major elements constituting the present invention 10. The present invention has three major elements. These are the flag attachment means, the flag gripping means and a tongue 51. The attachment means and gripping each have a primary and secondary embodiment which are discussed in detail below. Briefly, the tongue 51 is inserted in the crevice 3 created between the hood 2 and the remaining portion of the car 1. The tongue can be adjusted to allow for varying hood thickness 4. (4A in FIGS. 2A and 5 shows the length which may be adjusted.) This is accomplished by using an internally threaded mast and externally threaded base. The internally threaded portion of the mast is referred to as the female mounting portion 53 and connected therein is the externally threaded portion of tongue 51 referred to as the male mounting threaded portion 52. These can be adjusted to insure a tighter and more secure fit to the hood. A gripping means is tightened to ensure that the invention remains affixed to the car. The flag is attached to the flag attachment means. The flag attachment means is designed to prevent the flag from creeping up the mast while the system is in operation. The flag attachment means ensures the flag remains vertically spread at all times.

Figure 4:
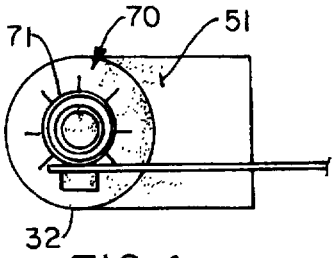
FIG. 4 is a top view which illustrates the secondary embodiment of the present invention.
Figure 6:
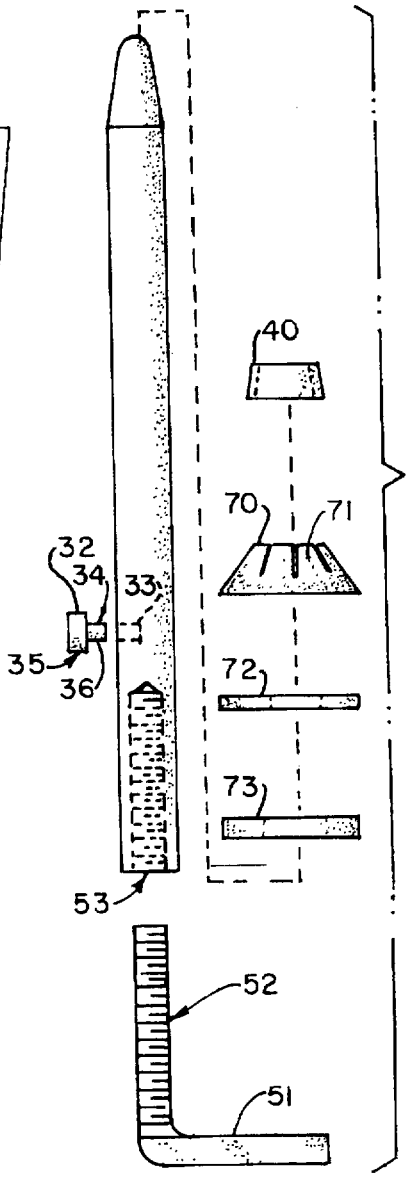
FIG. 6 is a side view which illustrates the primary embodiment of the hood gripping means of the present invention.

Now that the general operation has been reviewed, the detailed elements can be examined. The flag attachment means consists of a primary and secondary embodiment. The primary embodiment of the flag attachment means is illustrated in FIGS. 4, 5 and 6. The mast 20 has a base 23 and a pinnacle 24. The flag 21 has a pin receiving opening located at its lower vertical edge. The pin 32 has a pin head 35 and a pin base 36. Located on the pin base 36 is the pin securing means 34. This means can consist of threads, an expandable pin or a conventional locking mechanism. The mast 20 has a pin receiving cavity 33 located at the base. To attach the flag, the flag is placed over the mast. When the pin receiving cavity and the pin receiving opening are aligned, the pin is inserted pin base first. The pin base 36 is then secured to the mast by the pin securing means 34. The crown 40 is placed on top of the mast to further limit the flag from moving. This configuration limits the tendency for the lower edge of the flag to 'creep-up' during use.

Figure 2B:
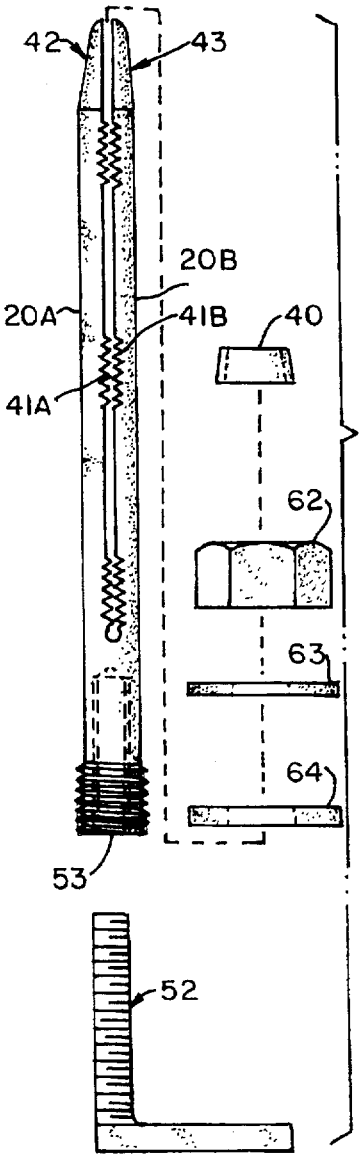
FIG. 2B is a side view which illustrates the crown of the primary embodiment of the flag attachment means of the present invention.
Figure 3:
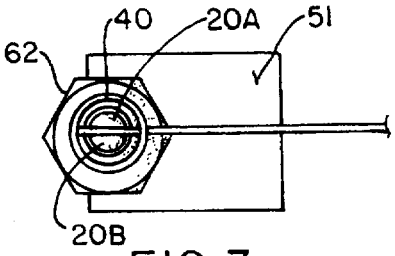
FIG. 3 is a top view which illustrates the primary embodiment of the present invention.

The secondary embodiment of the flag attachment means is illustrated in FIGS. 2 and 3. This embodiment consists of a crown 40, a first flexible mast 20A, an opposing second flexible mast 20B, a base 23 and a pinnacle 24 (when the masts are compressed). When viewed from the top, each flexible mast has a semicircle configuration. At the top of the first flexible mast in the first conical tip 42. This is opposed by a second conical tip 43. There is a slight taper. When these opposing tips are pressed together by the crown 40, the flag 21 is bound between the opposing masts. To further help the flag to be bound to the mast, there are gripping teeth 41A and 41B located on the opposing surfaces of the first flexible mast and second flexible mast, respectively. These gripping teeth prevent the flag from 'creeping' up the mast.

The hood gripping means has a primary and secondary embodiment. The first embodiment has consist of a threaded portion 61 located at the lower portion of the mast. A clamping nut 62 is threaded on the threaded portion 61. By rotating the nut 62 the length 4A can be altered, attaching the mast to the car. At the base of the nut 62 there is place a steel washer 63. Underneath the washer is a insulation pad 64. This insulation pad acts as a cushion to prevent paint damage and also acts to minimize heat damage to the flag assembly from the car's engine.

The secondary embodiment of the gripping means is a sliding clamp cap 70 which is inserted onto the mast. The cap has several teeth 71 which grip the mast. The mast may be affixed to an automobile hood by forcing the cap down to exert pressure onto the hood. This alters the length 4A. Underneath the cap is a steel washer 72 and an insulation pad 73.

It will be obvious to those skilled in the art that various changes may be made without departing from the scope of the invention and the invention is not to be considered limited to what is illustrated in the drawings and described in the specification.

What is claimed is:

1. A flag system for displaying a flag from a hood of an automobile comprising:

a) a means for attaching the flag to a mast, said means ensuring the flag remains vertically spread on the mast at all times, said mast having a base and a pinnacle;

b) a means for gripping an automobile's hood, said means located at the base; and c) a tongue connected to the gripping means, said tongue passing between a crevice created between the hood and the automobile, said tongue having a male mounting threaded portion threadably connected to a female mounting portion in said base of said mast.

2. The flag system in claim 1, wherein said flag attachment means comprises:

a) a pin with a pin head and a pin base;

b) a pin securing means located at the pin base;

c) the base of the mast having a pin receiving cavity, therein; and d) the flag having a pin receiving opening; whereby the pin base is inserted through the pin receiving opening and placed into the pin receiving cavity allowing the flag to remain vertically spread.

3. The flag system in claim 2, wherein the hood gripping means comprises:

a) a threaded portion located at the base;

b) a threaded nut which is rotationally mated with the threaded portion; and c) a steel washer which contacts the threaded nut;

d) an insulated pad which contacts the steel washer, whereby the threaded nut is tightened on the threaded portion to secure the flag system to the hood.

4. The flag system in claim 2, wherein the hood gripping means comprises:

a) a sliding cap with a plurality of interior gripping teeth, each gripping tooth contacting the mast; and b) a steel washer which contacts the sliding cap;

c) an insulated pad which contacts the steel washer, whereby the cap is pressed to secure the flag system to the hood.

5. The flag system is claim 1, wherein said flag attachment means comprises said mast which further comprises:

a) a first flexible mast with a plurality of first gripping teeth and a first conical tip, said first mast attached to the base;

b) a second flexible mast with a plurality of second gripping teeth and a second conical tip, said second gripping teeth opposing said first gripping teeth, said second mast attached to the base;

c) a crown placed on the pinnacle, whereby the flag is placed between the first gripping teeth and second gripping and the crown is fitted onto the first conical tip and second conical tip allowing the flag to remain vertically spread.

6. The flag system in claim 5, wherein the hood gripping means comprises:

a) a threaded portion located at the base;

b) a threaded nut which is rotationally mated with the threaded portion; and c) a steel washer which contacts the threaded nut;

d) an insulated pad which contacts the steel washer, whereby the threaded nut is tightened on the threaded portion to secure the flag system to the hood.

7. The flag system in claim 5, wherein the hood gripping means comprises:

a) a sliding cap with a plurality of interior gripping teeth, each gripping tooth contacting the mast; and b) a steel washer which contacts the sliding cap;

c) an insulated pad which contacts the steel washer, whereby the cap is pressed to secure the flag system to the hood.

* * * * *